US009739537B2

(12) United States Patent
Pomin et al.

(10) Patent No.: US 9,739,537 B2
(45) Date of Patent: Aug. 22, 2017

(54) HEAT EXCHANGER

(71) Applicants: Mahle International GmbH, Stuttgart (DE); Mahle Behr GmbH & Co. KG, Stuttgart (DE)

(72) Inventors: Hubert Pomin, Sindelfingen (DE); Juergen Stehlig, Neckartenzlingen (DE); Veit Bruggesser, Hildrezhausen (DE); Andreas Eilemann, Erdmannhausen (DE); Christian Saumweber, Stuttgart (DE)

(73) Assignees: Mahle International GmbH (DE); Mahle Behr GmbH & Co. KG (DE)

( * ) Notice: Subject to any disclaimer, the term of this patent is extended or adjusted under 35 U.S.C. 154(b) by 246 days.

(21) Appl. No.: 14/653,265

(22) PCT Filed: Oct. 18, 2013

(86) PCT No.: PCT/EP2013/071876
§ 371 (c)(1),
(2) Date: Jun. 17, 2015

(87) PCT Pub. No.: WO2014/095121
PCT Pub. Date: Jun. 26, 2014

(65) Prior Publication Data

US 2015/0338167 A1 Nov. 26, 2015

(30) Foreign Application Priority Data

Dec. 18, 2012 (DE) ..... 10 2012 223 644

(51) Int. Cl.
*F28D 1/04* (2006.01)
*F28D 1/02* (2006.01)
(Continued)

(52) U.S. Cl.
CPC ..... *F28D 1/0233* (2013.01); *F28D 1/05308* (2013.01); *F28D 1/05391* (2013.01);
(Continued)

(58) Field of Classification Search
CPC ..... F28D 1/0233; F28D 1/05308; F28D 1/05391; F28D 1/04; F28D 7/00;
(Continued)

(56) References Cited

U.S. PATENT DOCUMENTS 530,317 A * 12/1894 Young ..... F28F 9/0246 165/76
1,705,471 A * 3/1929 De Beauvais ..... F28D 9/0062 165/103

(Continued)

FOREIGN PATENT DOCUMENTS

DE 19811629 A1 9/1998
DE 20118511 U1 2/2002

(Continued)

OTHER PUBLICATIONS

Japanese Office Action, Patent Application No. 2015-546906, dated Jul. 5, 2016.

(Continued)

*Primary Examiner* — Justin Jonaitis
(74) *Attorney, Agent, or Firm* — Fishman Stewart PLLC

(57) ABSTRACT

A heat exchanger for transferring heat between a gaseous first fluid and a liquid second fluid may include a plurality of hollow pipes extending transversely through a first fluid path for conducting the first fluid. The plurality of pipes may be coupled externally to a plurality of cooling fins arranged in the first fluid path. The plurality of pipes may internally define a second fluid path for conducting the second fluid. The plurality of pipes and the plurality of cooling fins may be arranged stacked on one another in a stacking direction to (Continued)

define a cooler block. The cooler block may include two side parts extending along two outer sides of the cooler block facing away from one another in the stacking direction. At least one tension rod may fixedly connect the two side parts and be configured to transmit a tensile force in the stacking direction.

19 Claims, 5 Drawing Sheets

(51) Int. Cl.
*F28D 1/053* (2006.01)
*F28F 1/12* (2006.01)
*F28F 9/00* (2006.01)

(52) U.S. Cl.
CPC ..... *F28F 1/128* (2013.01); *F28F 9/001* (2013.01); *F28F 2275/08* (2013.01); *F28F 2275/122* (2013.01); *F28F 2275/14* (2013.01); *F28F 2280/02* (2013.01)

(58) Field of Classification Search
CPC ..... F28D 9/00; F28D 1/0308; F28D 9/0006; F28D 9/0025; F28D 9/0031; F28D 9/0037; F28D 9/0062; F28D 9/0081; F28F 1/128; F28F 9/001; F28F 2275/122; F28F 2275/14; F28F 2280/02; F28F 1/10; F28F 1/12; F28F 1/24; F28F 1/32; F28F 2280/06; F28F 3/005; F28F 3/08; F28F 3/02; F28F 3/083; F01P 3/18; B60K 11/04
USPC ..... 165/151, 148, 149, 164, 166, DIG. 186, 165/DIG. 470
See application file for complete search history.

(56) References Cited

U.S. PATENT DOCUMENTS

| | | | | |
|---|---|---|---|---|
| 2,016,164 | A * | 10/1935 | Williams | F28D 1/03 165/128 |
| 2,984,456 | A * | 5/1961 | Young | F28D 1/02 138/37 |
| 4,119,144 | A | 10/1978 | Kun | |
| 5,014,771 | A * | 5/1991 | Oddi | B23K 1/0012 165/149 |
| 5,325,915 | A | 7/1994 | Fouts et al. | |
| 6,055,360 | A | 4/2000 | Inoue et al. | |
| 6,265,692 | B1 * | 7/2001 | Umebayahi | B60H 1/00064 165/299 |
| 2014/0130764 | A1 | 5/2014 | Saumweber et al. | |

FOREIGN PATENT DOCUMENTS

| | | | |
|---|---|---|---|
| DE | 102009043064 | A1 | 5/2010 |
| DE | 102011100629 | A1 | 11/2012 |
| JP | 2001-324292 | A | 11/2001 |

OTHER PUBLICATIONS

Japanese Office Action translation, Patent Application No. 2015-546906, dated Jul. 5, 2016.
English Abstract for JP-2001-324292 (A).

* cited by examiner

HEAT EXCHANGER

CROSS-REFERENCE TO RELATED APPLICATIONS

This application claims priority to German Patent Application No. 10 2012 223 644.9, filed Dec. 18, 2012, and International Patent Application No. PCT/EP2013/071876, filed Oct. 18, 2013, both of which are hereby incorporated by reference in their entirety.

TECHNICAL FIELD

The present invention relates to a heat exchanger for transferring heat between a gaseous first fluid and a liquid second fluid. The invention also relates to a fresh air system of an internal combustion engine, preferably of a motor vehicle, which is equipped with such a heat exchanger.

BACKGROUND

Heat exchangers of this type are used for example in vehicles e.g. in order to dissipate heat from a cooling circuit, in which a liquid coolant circulates, or respectively in order to supply heat to an air stream which can be discharged into the environment or can be supplied to a vehicle interior for the heating thereof. Preferably, the heat exchanger is a charge air cooler, which is arranged downstream of a charging arrangement, for example a turbocharger, in a fresh air system for supplying an internal combustion engine with fresh air, in order to cool the charge air which is compressed and heated here, before it is supplied to the combustion chambers of the internal combustion engine.

Such a heat exchanger can be configured for example as a fin-pipe heat exchanger and can accordingly have multiple pipes which extend through a first fluid path for conducting the first fluid, said pipes externally being coupled in heat-transmitting fashion to cooling fins which are arranged in the first fluid path and through or respectively around which the first fluid can flow and said pipes internally forming a second fluid path for conducting the second fluid. For the case where the heat exchanger forms a charge air cooler, a liquid coolant flows in the pipes, whilst the charge air flows in the region of the cooling fins.

In such a fin-pipe heat exchanger, the pipes and the cooling fins are stacked on one another as it were in layers in a stacking direction for the formation of a cooler block, wherein this stacking direction extends transversely to a main flow direction, which the first fluid has in the first fluid path. Such a cooler block can now have, on two outer sides facing away from one another in the stacking direction, in each case a side part for lateral delimitation of the first fluid path.

For the integration of such a heat exchanger into a gas-conducting duct, for example a fresh air duct, it can be necessary, to avoid leakages or respectively a bypass, to connect the said side parts of the cooler block with duct walls which lie opposite one another in the region of the heat exchanger. Depending on the type of such a connection, a transmission of tensile forces can occur here between the respective duct wall and the respective side part. These tensile forces are transmitted within the cooler block via the cooling fins and pipes layered on one another. As usually a particularly light construction is aimed for in vehicle manufacture, the cooling fins, like the pipes and the side parts, have wall thicknesses which are as small as possible. Hereby, in particular, the cooling fins in the region of connecting sites, via which they are fixedly connected with the adjacent pipes or respectively with one of the side parts, can be exposed to high mechanical stresses, which can lead to a failure of the connections, which can be, for example, soldered connections, and/or can lead to a failure of the cooling fins. Damage to the heat exchanger also involves a reduced efficiency. Additionally or alternatively, the heat exchanger can expand in operation, whereby compressive forces occur in the heat exchanger, which can likewise stress the connections.

SUMMARY

The present invention is concerned with the problem of indicating for a heat exchanger of the above-mentioned type, or respectively for a fresh air system equipped therewith, an improved embodiment which has in particular an increased stability, e.g. for tensile stresses which affect the side parts of the cooler block.

This problem is solved according to the invention by the subjects of the independent claims. Advantageous embodiments are the subject of the dependent claims.

The present invention is based on the general idea of connecting the two side parts fixedly with one another by means of at least one tension rod. By means of such tension rods, tensile forces can be transmitted in the stacking direction between the two side parts, without the cooling fins and the pipes and their connections being excessively stressed. The risk of damage to the cooling fins or respectively their connection to the pipes or respectively to the respective side part can thereby be significantly reduced.

According to an advantageous embodiment, at least one such tension rod can be arranged externally on the cooler block on an inflow side of the cooler block with respect to the first fluid path or on an outflow side of the cooler block with respect to the first fluid path and can connect the two side parts with one another at said inflow side or respectively at said outflow side. It is clear that for the case where at least two such tension rods are provided, both on the inflow side and on the outflow side respectively at least one such tension rod can be arranged. Such a tension rod, which can be mounted onto the cooler block on the inflow side or respectively on the outflow side, can be mounted on the cooler block without the cooler block having to be laboriously remodelled for this, whereby this embodiment is able to be realized in a particularly simple and cost-efficient manner.

According to an advantageous further development, at least one such tension rod can be configured as a U-shaped bracket, which overlaps with its U-legs, which are connected with one another via a U-base, the two side parts from the exterior. Hereby, a particularly robust form-fitting connection of the respective tension rod with the two side parts is created, which can be subject to tensile stresses to a considerable extent.

The respective side part can have a flange on an edge on the inflow side and/or on the outflow side, which flange projects outwards, i.e. directed away from the cooling fins and the pipes, in particular parallel to the stacking direction. By means of such a flange, the bending stiffness of the respective side part can be increased accordingly.

In another further development, at least one such tension rod can now be configured so that it embraces with an end region such a flange of the respective side part. Hereby, likewise, a form-fitting connection is realized between said tension rod and the respective side part. Via the flange, the tensile force is concentrated from the respective side part and transmitted locally to the respective tension rod.

In order to now be able to arrange the respective tension rod in a countersunk manner in the flange, a recess can be provided in the flange in the region of the respective tension rod, into which recess the respective tension rod engages with the associated end region, in order to embrace the flange there.

Also in the case of such a tension rod which embraces a flange on the respective side part, an embodiment as a U-shaped bracket can be realized, wherein then the respective U-leg embraces the respective flange at its end remote from the U-base.

In another further development, at least one such tension rod can be configured as a U-shaped bracket, the U-legs of which contact the two side parts on inner sides facing one another. In this case, the U-legs are connected with the side parts in a suitable manner, preferably by means of materially bonded connections. The U-legs can, for example, be welded or soldered to the side parts.

In another advantageous further development, the side parts can project over the cooler block at least in the region of the respective tension rod parallel to the main flow direction of the first fluid. Hereby, the use of U-shaped brackets as tension rod is simplified. Additionally or alternatively, provision can be made to equip the cooler block with a depression at least in the region of the respective tension rod, into which depression the respective tension rod at least partially projects. Therefore, the respective tension rod can be arranged in a countersunk manner at least partially in said depression. In particular, thereby a compact outer contour of the cooler block can be retained. In particular, the exterior tension rods can thereby not form an intrusive contour for the handling of the cooler block.

In another advantageous further development, at least one such tension rod can be configured as a clip on at least one of its ends remote from one another in the stacking direction, which clip embraces the respective side part on the edge side externally and internally. Hereby, also, a particularly simple form-fitting connection can be realized, which can reliably transmit high tensile forces.

According to another advantageous embodiment, at least one such tension rod can be configured in a comb-like manner, so that it has a base running parallel to the stacking direction and at least three prongs projecting from the base parallel to the main flow direction of the first fluid. Here, at least three such prongs are provided, namely two exterior prongs and at least one interior prong. Whilst the two exterior prongs, remote from one another, expediently overlap the two side parts from the exterior, the at least one interior prong engages into the cooler block. Here, the at least one interior prong can plunge between two pipes in the region of a cooling fin. The respective interior prong can be in contact with at least one cooling fin and/or with at least one pipe and in particular can be fixedly connected therewith. Likewise, however, it is possible to arrange the respective interior prongs loosely with respect to the cooling ribs and the pipes and/or in a contact-free manner.

According to an advantageous further development, the respective tension rod can be a flat sheet metal part, in the plane of which the base and the prongs respectively extend with their flat cross-sections. Hereby, a tension rod is produced which is able to be realized particularly simply, which, for example, is able to be realized as an off-tool stamped part. In particular, the base can project over the cooler block here with respect to the main flow direction of the first fluid, whereby a type of labyrinth seal is created, which prevents transverse flows, in order to thus support a straight, interference-free through-flow of the cooler block in the first fluid path.

In another advantageous embodiment, at least on such tension rod can be arranged in the interior of the cooler block between an inflow side and an outflow side of the cooler block with respect to the first fluid path and can connect the two side parts to one another there. Through such an internal tension rod, the force transmission between the side parts can be shifted into the interior of the cooler block. Hereby, in particular the bending stress of the respective side part can be reduced.

According to an advantageous further development, the respective tension rod can project over the cooler block at least on one of the side parts in the stacking direction, and can be connected with the respective side part outside the cooler block. Through this measure, the force transmission between the side parts and the tension rods can be realized outside the cooler block, which is delimited by the inner sides of the two side parts facing one another, so that the entire interior of the cooler block is relieved or respectively uncoupled from this force transmission.

For example, in another advantageous embodiment, at least one of the side parts can have a sealing contour on an outer side facing away from the cooler block, which sealing contour extends transversely to the main flow direction of the first fluid and transversely to the stacking direction. In the installed state of the heat exchanger, by means of such a sealing contour for example a bypass flow, which bypasses the heat exchanger, can be prevented.

According to an advantageous further development, the respective internal tension rod can now be integrated into this sealing contour. For example, the tension rod can be incorporated in a suitable manner into said sealing contour, in particular soldered in. In particular in the region of this sealing contour, preferably via this sealing contour, an introduction of tensile force to the side parts can take place, wherein through the proposed type of construction a direct force transmission to the tension rod is achieved, in which also the side parts are scarcely stressed.

In an advantageous further development, at least one of the side parts can be configured in two parts, wherein the two individual parts of the respective side part abut one another for the formation of the sealing contour. Through this multi-part type of construction of the side parts, the respective tension rod can be incorporated particularly simply into the joint and preferably into the sealing contour.

According to another advantageous embodiment, the respective tension rod can extend in a width direction of the cooler block, which runs transversely to the stacking direction and transversely to the main flow direction of the first fluid, over a relatively small part of the width of the cooler block, for example over a maximum of 10% or a maximum of 5% of the entire width of the cooler block. Therefore, the respective tension rod has only a relatively small influence on the through-flow resistance of the cooler block within the first fluid path. This applies both for external tension rods arranged on the inflow side or outflow side and also for internal tension rods.

The respective tension rod can be designed as a sheet metal shaped part, which is able to be produced in an economical manner by simple deformation.

The different embodiments of the tension rods described above can basically be combined with one another as desired, such that on the same cooler block at least two different tension rods can be present. However, embodiments are preferred, in which respectively similar tension rods are used.

In a fresh air system according to the invention, a fresh air duct is provided for the conducting of fresh air, into which duct a heat exchanger of the type described above is inserted to that the fresh air forms the first fluid and can flow through the heat exchanger along the first fluid path. The fresh air duct expediently has on two duct walls, lying opposite one another, respectively a coupling with the respective side part of the heat exchanger, which in particular can transmit tensile forces. In this way, the duct walls can transmit tensile forces to the side parts and therefore to the cooler block, which in the heat exchanger according to the invention are largely received by the respective tension rod.

The coupling between the respective duct wall and the respective side part can be expediently configured as a bypass seal, in order to prevent a flowing around of the heat exchanger on the fresh air side. Expediently, said coupling therefore extends over the entire width of the cooler block. Said coupling can be designed for example as a tongue/groove guide, the guiding direction of which runs parallel to the width direction of the cooler block, i.e. transversely to the main flow direction of the first fluid and transversely to the stacking direction. Therefore, the cooler block can be inserted in its width direction into the respective guide and, guided thereon, inserted laterally into the fresh air duct.

On at least one of the tension rods, which is arranged on the inflow side or respectively on the outflow side of the cooler block, a flow guide surface can be provided, which brings about a reduction of the through-flow resistance of the cooler block. Additionally or alternatively, the respective tension rod can have at least one passage opening, which likewise reduces the through-flow resistance of the cooler block. Such an opening can be provided in the case of an external tension rod, which is arranged on the inflow side or outflow side on the cooler block just as in the case of an internal tension rod, which is arranged between the inflow side and the outflow side in the cooler block.

Further important features and advantages of the invention will emerge from the subclaims, from the drawings and from the associated figure description with the aid of the drawings.

It shall be understood that the features mentioned above and to be further explained below are able to be used not only in the respectively indicated combination, but also in other combinations or in isolation, without departing from the scope of the present invention.

BRIEF DESCRIPTION OF THE DRAWINGS

Preferred example embodiments of the invention are illustrated in the drawings and are explained in further detail in the following description, wherein the same reference numbers refer to identical or similar or functionally identical components.

There are shown, respectively diagrammatically.

DETAILED DESCRIPTION

Figure 1:
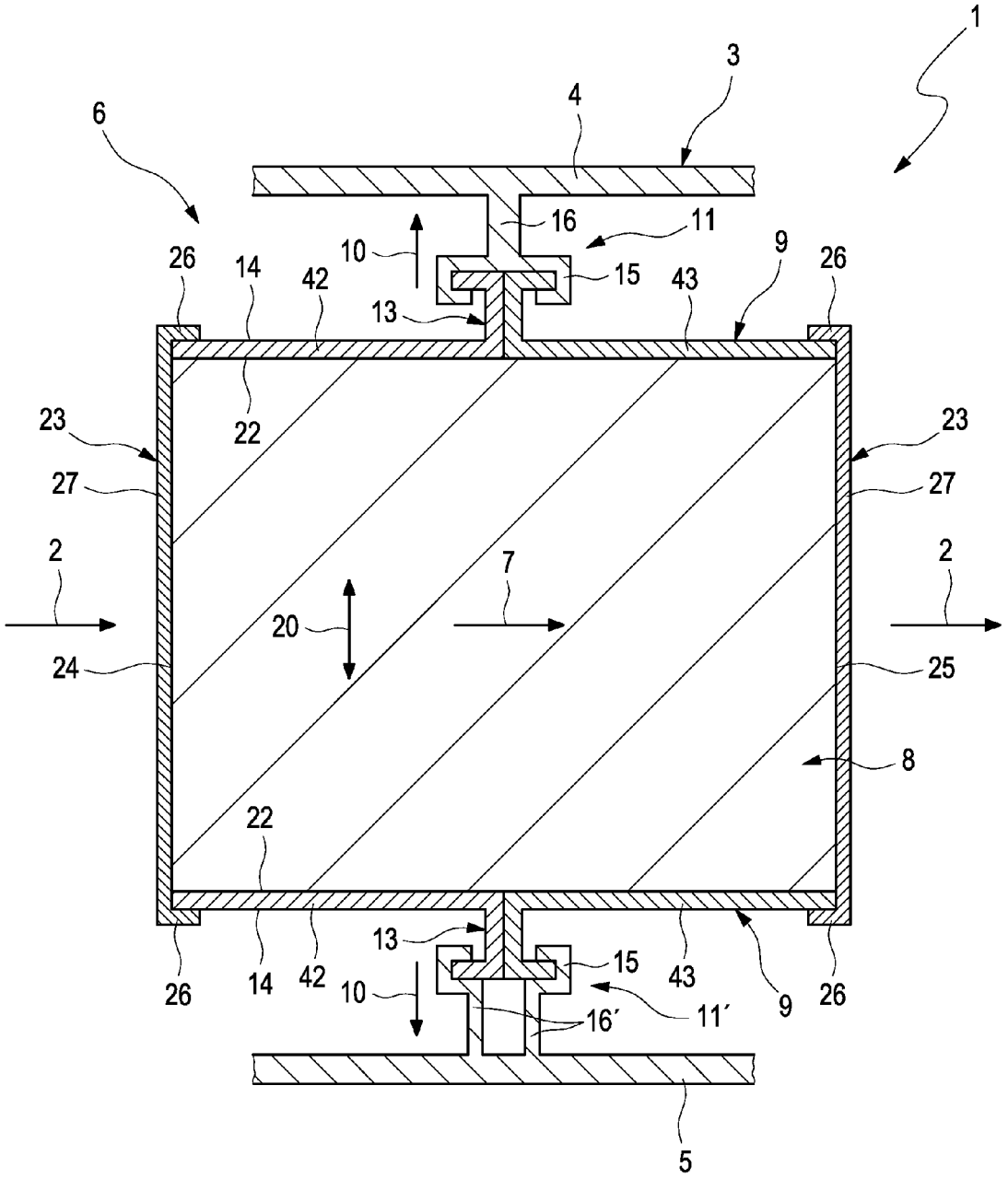
FIG. 1 a greatly simplified sectional illustration of a fresh air system in the region of a heat exchanger, FIG. 2 a detail view in section of the heat exchanger in another embodiment, FIG. 3 a side view of a tension rod in a further embodiment, FIG. 4 an exploded isometric view of a further heat exchanger, FIG. 5 an exploded, isometric illustration of the heat exchanger as in FIG. 4, but in another embodiment, FIG. 6 an isometric view of a further heat exchanger, FIG. 7 a sectional view of the heat exchanger in another embodiment.

In FIG. 1 a fresh air system 1 is only partially illustrated, by means of which the combustion chambers of an internal combustion engine, not shown here, which can preferably be arranged in a vehicle, is supplied with fresh air. This is preferably a charged internal combustion engine, in which a corresponding charging arrangement, for example a Roots blower or a turbine, preferably of an exhaust gas turbocharger, is situated in the fresh air system 1. The cutout of the fresh air system 1 shown in FIG. 1 is situated downstream of the respective charging arrangement with respect to a flow 2 of the fresh air or respectively charge air. The fresh air system 1 comprises a fresh air duct 3, which serves for the guiding of fresh air or respectively charge air, so that the air flow 2 can form in the fresh air duct 3 during operation of the internal combustion engine. In FIG. 1, only two duct walls 4, 5 of the fresh air duct 3 can be seen, which lie opposite one another and respectively delimit the air flow 2 laterally. The fresh air system 1 is, in addition, equipped with a heat exchanger 6 serving as charge air cooler, which is inserted into the fresh air duct 3 so that the fresh air flow 2 can flow through the heat exchanger 6 along a first fluid path 7, which is formed in the heat exchanger 6 for a gaseous first fluid. The heat exchanger 6 comprises here a cooler block 8, which is delimited laterally, on two sides facing away from each other, respectively by a plate-shaped side part 9. The two side parts 9 serve here in the heat exchanger 6 for the lateral delimiting of the first fluid path 7. In the installed state, the two duct walls 4, 5 can be coupled with the two side parts 9 so that tensile forces 10 can be transmitted, which are indicated by arrows in FIG. 1. Accordingly, the one duct wall 4 can introduce tensile forces 10 to the one side part 9, whilst the other duct wall 6 can introduce tensile forces 10 to the other side part 9, wherein the tensile forces 10 affecting the two side parts 9 are directed away from one another. Subsequently, the heat exchanger 6 or respectively its cooler block 8 can be exposed to a tensile force stress. Additionally or alternatively, the arrows designated by reference number 10 can also represent compressive forces, which in the heat exchanger 6, e.g. caused thermally, can arise through expansion of the heat exchanger 6.

Figure 4:
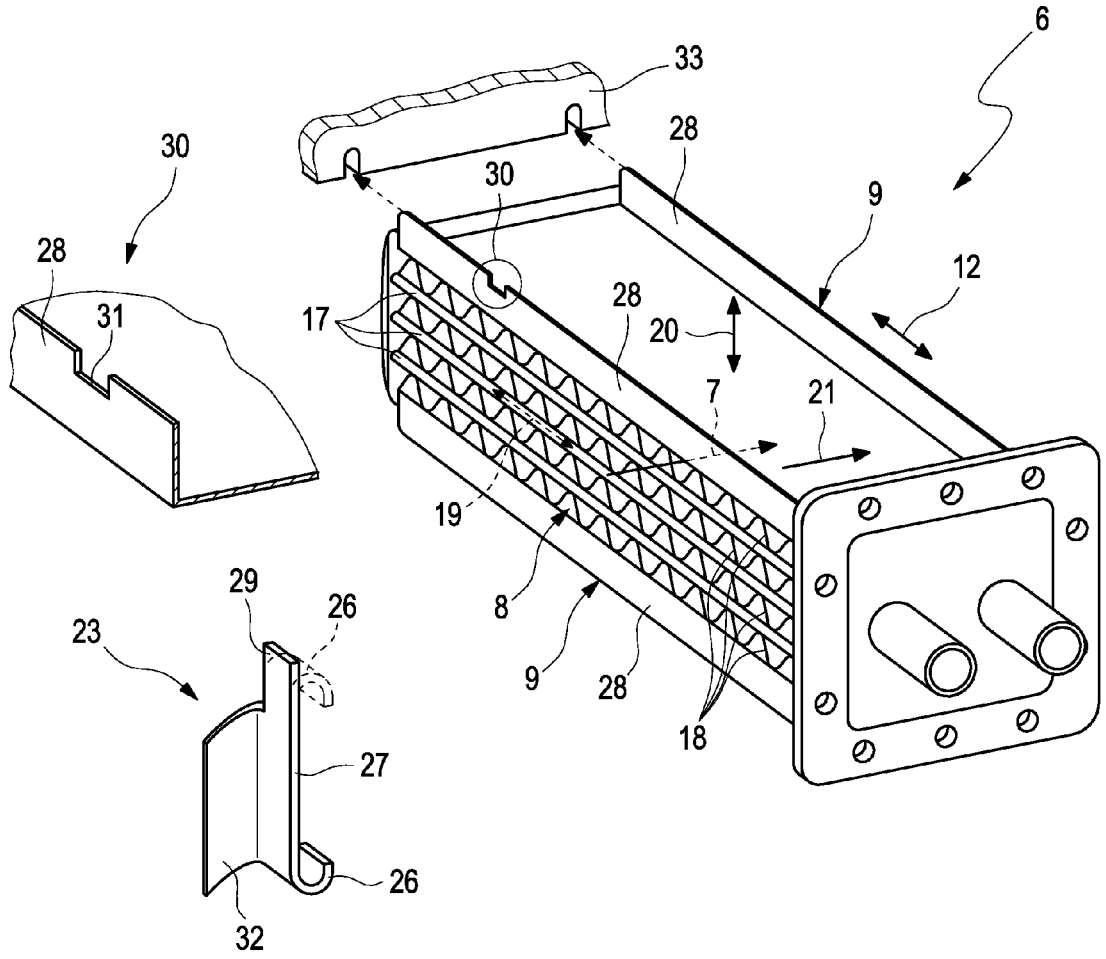
Figure 5:
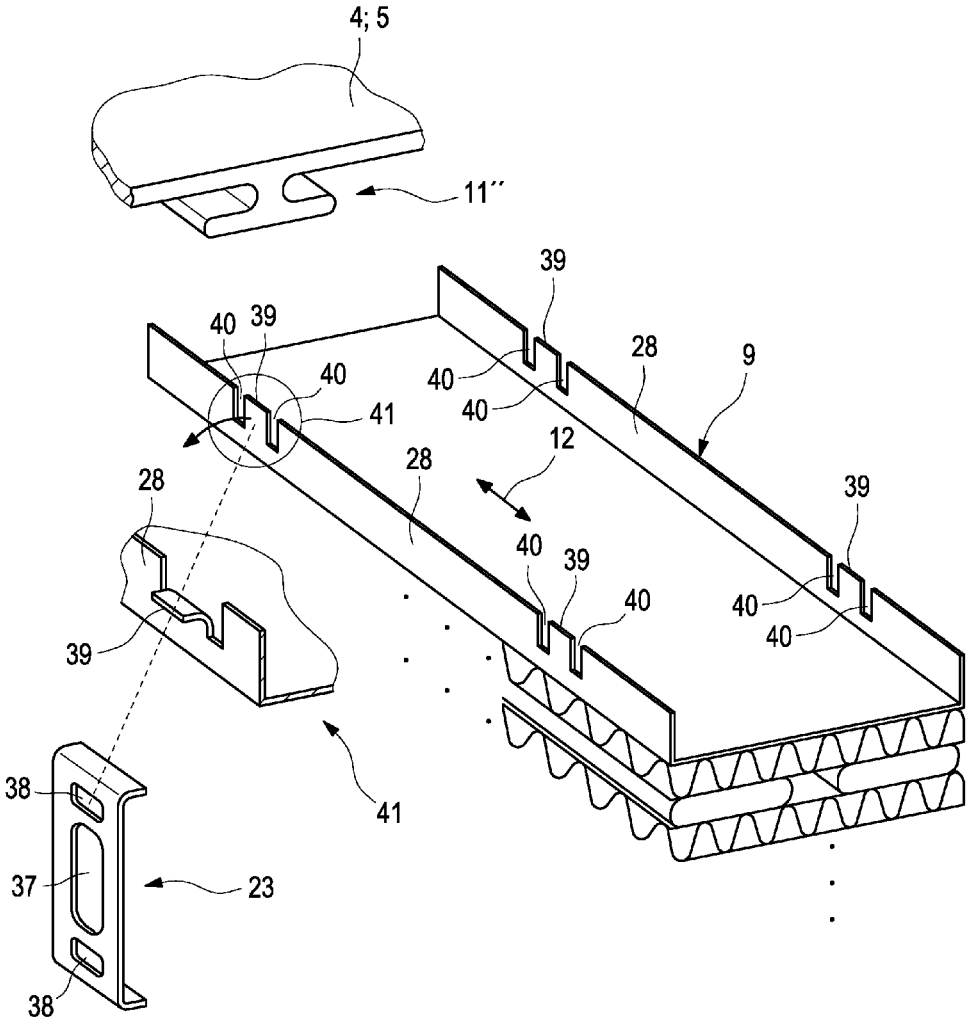

The coupling between the duct walls 4, 5 and the side parts 9 takes place here respectively via a corresponding coupling arrangement 11 or respectively 11'. In FIG. 1, two different variants of such a coupling arrangement 11, 11' are illustrated. One duct wall 4 is coupled with the facing side part 9 via a first variant of the coupling arrangement 11. The other duct wall 5 is coupled with the facing side part 9 via a second variant 11'. In both cases, the coupling arrangements 11, 11' are configured as a bypass seal, in order to prevent a bypass flow bypassing the heat exchanger 6 in the fresh air duct 3. In the example, both coupling arrangements 11, 11' are designed as a tongue/groove guide, the guide direction of which runs perpendicularly to the section plane and therefore perpendicularly to the plane of the drawing of FIG. 1. Expediently, the respective coupling arrangement 11, 11' extends over the entire width of the cooler block 8, wherein a width direction of the cooler block 8 in FIGS. 4 and 5 is indicated by a double arrow 12. The respective coupling arrangement 11, 11' comprises on the part of the heat exchanger 6 on the respective side part 9 a sealing contour 13, which is arranged for this on an outer side 14 of the respective side part 9 facing away from the cooler block 8. In the example, the respective sealing contour 13 is T-shaped in profile. In a complementary manner thereto, the respective coupling arrangement 11, 11' on the part of the respective duct wall 4, 5 is equipped with a corresponding mount contour 15, which is in engagement with the respective sealing contour 13, such that on the one hand the desired sealing and on the other hand the desired tensile force transmission is realized. The two variants of the coupling arrangements 11, 11' differ from one another by the connection of the respective mount contour 15 to the associated duct wall 4, 5. In the first embodiment of the coupling arrangement 11, the mount contour 15 is connected with the associated duct wall 4 via a one-piece web. This embodiment can be produced particularly simply. The second embodiment of the coupling arrangement 11', on the other hand, is equipped with a two-piece web 16', in order to connect the mount contour 15 with the associated duct wall 5. In this case, manufacturing tolerances oriented parallel to the air flow direction 2 can be received better, because an elastic coupling between the sealing contour 13 and the mount contour 15 can be achieved.

According to FIGS. 2 to 7, the heat exchanger 6 contains multiple pipes 17, which extend through the first fluid path 7. In addition, cooling fins 18 are provided, which are arranged externally on the pipes 17, are coupled with these in heat-transmitting fashion and which in addition are also arranged in the first fluid path 7, so that they can be flowed through or respectively flowed around by the first fluid. The pipes 17 define in their interior a second fluid path 19 for guiding a second fluid, which is liquid and which is preferably a coolant. The pipes 17 and the cooling fins 18 are stacked on one another in a stacking direction 20, so that in particular a layered arrangement of pipes 17 and cooling fins 18 can form. This stack of pipes 17 and cooling fins 18 forms the cooler block 8. The stacking direction 20 extends transversely to a main flow direction 21 of the first fluid in the first fluid path 7. This main flow direction 21 runs here parallel to the air flow 2 and parallel to a longitudinal direction of the cooler block 8, which can also be designated below by 21. The stacking direction 20 therefore extends parallel to a vertical direction of the cooler block 8, which can also be designated below by 20.

The cooler block 8 is equipped on its outer sides, facing away from one another in the stacking direction 20, respectively with one of the above-mentioned side parts 9 for the lateral delimitation of the first fluid path 7. For this, the two side parts 9 face the cooler block 8 by their inner sides 22 facing one another. Expediently, the cooling fins 18 are soldered to the pipes 17. The cooling fins 18 arranged on the outer sides of the cooler block 8 can also be soldered to the respective side part 9.

The two side parts 9 can now be fixedly connected with one another via at least one tension rod 23, such that a tensile force transmission is possible in the stacking direction 20. Expediently here several such tension rods 23 are provided. The tension rods 23 can therefore transmit the tensile forces 10, shown in FIG. 1, which are transmitted via the duct walls 4, 5 to the side parts 9, directly between the side parts 9, without an excessive tensile stress occurring here in the interior of the cooler block 8, so that in particular the pipes 17 and the cooling fins 18 are largely to completely uncoupled from these tensile forces 10.

As can be seen in FIG. 1, at least one such tension rod 23 can be arranged on an inflow side 24 of the cooler block 8 and can connect the two side parts 9 to one another there. Likewise, such a tension rod 23 can be arranged on an outflow side 25 of the cooler block 8, and can connect the two side parts 9 to one another there. The inflow side 24 and the outflow side 25 is related here to the air flow 2 or respectively to the main flow direction 21 in the first fluid path 7. Accordingly, the inflow side 24 faces the air flow 2, whilst the outflow side 25 faces way from the incoming airflow 2. In the example of FIG. 1, the illustrated tension rods 23 are designed as U-shaped brackets which have two U-legs 26 and one U-base 27, from which the two U-legs project. The tension rods 23 which are thus formed overlap the two side parts 9 with their U-legs 26 from the exterior. Hereby, a particularly intensive form fit is realized. Other such exterior or external tension rods 23 are also to be found in the embodiments of FIGS. 4 to 7. The tension rods 23 form separate components here, both with respect to the cooling fins 18 and also with respect to the pipes 17. They can also represent separate components with respect to the side parts 9.

In the embodiment shown in FIG. 4, the side parts 9 have on their inflow edge and on their outflow edge respectively an outwardly projecting flange 28, i.e. directed away from the cooler block 8. The respective flange 28 extends here parallel to the stacking direction 20 and parallel to the width direction 12 and preferably over the entire width of the cooler block 8. In this case, the U-legs 26 can embrace the flanges 28. The tension rod 23 shown in FIG. 4 has a straight end 29, illustrated by a continuous line, which can be shaped to the U-leg 26, which is indicated with a broken line. This shaping can take place on the cooler block 8 or respectively on the respective side part 9, in order to realize the desired intensive connection for the transmission of tensile force.

According to a detail 30, which is illustrated on an enlarged scale in FIG. 4 on the left adjacent to the cooler block 8, a recess 31 can be formed for the respective tension rod 23 in the respective flange 28, which recess is dimensioned for example in accordance with a wall thickness of the sheet metal part from which the respective tension rod 23 is produced. In this recess 31, the tension rod 23 can embrace the flange 28, whereby it is arranged in a countersunk manner in the flange 28. In the example of FIG. 4, a flow guide surface 32 is formed integrally on the tension rod 23, which flow guide surface reduces the flow resistance on the air side of the cooler block 8.

In FIG. 4 in addition a guide contour 33 can be seen, which can be constructed on or respectively in the fresh air duct 3, in order to be able to introduce the heat exchanger 6 in the width direction 12 into the fresh air duct 3.

Figure 6:
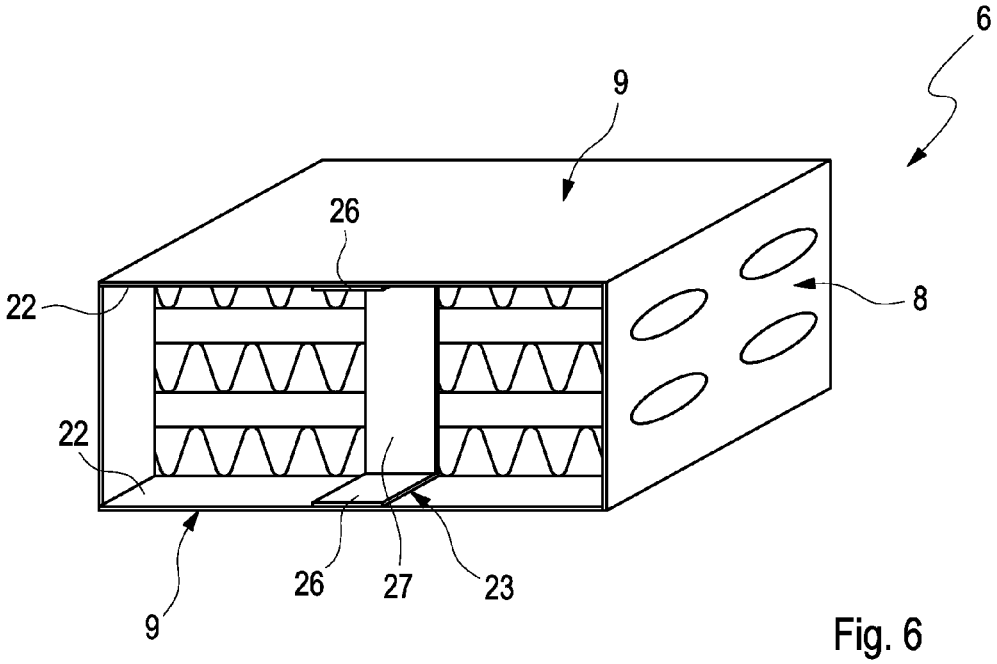

In the embodiment shown in FIG. 6, the respective tension rod 23 is likewise configured as a U-bracket, wherein in this case the U-legs 26 lie against the inner sides 22 of the two side parts 9, which face one another, and are fixedly connected in a suitable manner with the side parts 9, for example by means of a soldered connection or by means of a welded connection.

Figure 7:
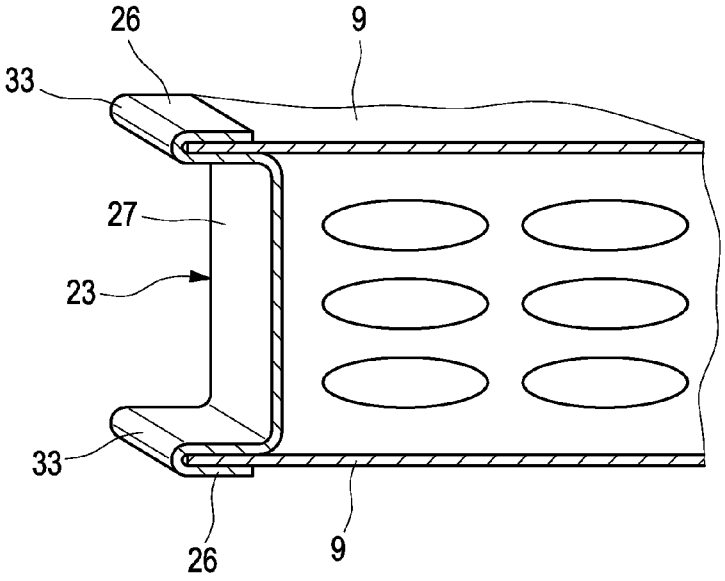

FIG. 7 shows an embodiment in which the tension rod 23 forms by its ends 33, remote from one another, respectively a clip which embraces the respective side part 9 on the edge side, i.e. on an edge on the inflow side or on an edge on the outflow side, and namely internally and externally. The clip-like ends 33 also define here U-legs 26, which are connected with one another via a U-base 27.

As can be seen in particular from FIGS. 6 and 7, the side parts 9, at least in the region of the respective tension rod 23, can project over the cooler block 8 preferably over the entire width of the cooler block 8 parallel to the main flow direction 21 or respectively parallel to the longitudinal direction 21 of the cooler block 8, i.e. over the arrangement of fins 18 and pipes 17. Hereby, the bracket-shaped tension rods 23 of FIG. 6 and the tension rods 23 of FIG. 7, provided with clips 33, can be mounted more easily. Additionally or alternatively, the cooler block 8 can have a depression at least in the region of the respective tension rod 23, which depression is not, however, illustrated here. The respective tension rod 23 can then project at least partially into the respective depression, whereby the external tension rod 23 is arranged at least partially in a countersunk manner in the cooler block 8.

Figure 3:
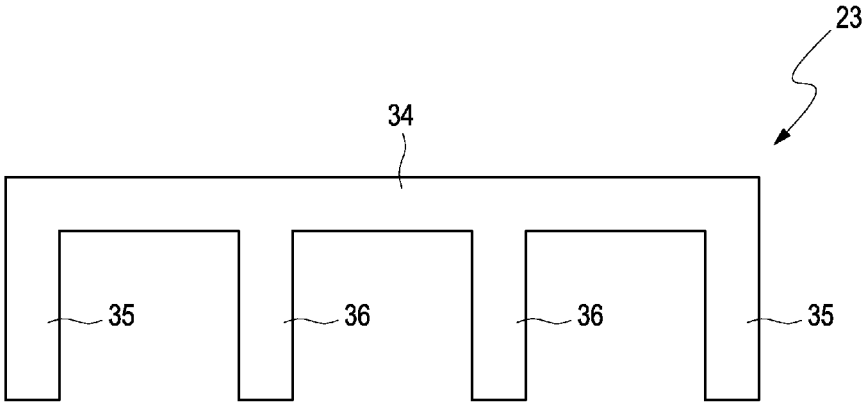

In the embodiment shown in FIG. 3, the tension rod 23 is configured in a comb-like manner. Accordingly, this tension rod 23 has a base 23, which in the mounted state extends parallel to the stacking direction 20, and at least three prongs 35, 36, which in the mounted state extend parallel to the main flow direction 21. The prongs 35, 36 project here from the base 34. Two exterior prongs 35, remote from one another, overlap here, as in the embodiment of FIG. 1, the two side parts 9 from the exterior. The two interior prongs 36 shown here engage here into the cooler block 8. The comb-like tension rod 23 is formed by a flat sheet metal part. A plane of this sheet metal part is defined here by the main extent directions of the base 34 and of the prongs 35, 36, i.e. by the stacking direction 20 running parallel to the base 34, and by the main flow direction 21 running parallel to the prongs 35, 36. The sheet metal part is "flat", as its thickness or material thickness, which is measured perpendicularly to the above-mentioned plane, is small compared to the dimensions of the base 34 and of the prongs 35, 36 within the said plane. In particular, this sheet metal thickness is a maximum of 50% of the smaller dimension of the base 34 or respectively of the prongs 35, 36 within the said plane. In the mounted state, the base 34 can project in the main flow direction 21 over the cooler block 8. Hereby, a labyrinth-type seal can be realized.

FIG. 5 shows a further embodiment for an external tension rod 23, which can also be designed as a U-shaped bracket. The tension rod 23 can have several apertures 37, 38. At least one of these apertures 37 can serve for the reducing of the through-flow resistance of the cooler block 8 on the air side. In the example of FIG. 5, two further openings 38 serve for the inserting of a lug 39, which is projected on the flange 28. For the projecting of the respective lug 39, the latter is cut free from the remaining flange 28 respectively with cuts 40 and in accordance with a detail 41 is angled outwards, parallel to the main flow direction 21. On mounting of the tension rod 23, the respective lug 39 penetrates the respective opening 38, whereby the respective tension rod 23 is fixed in the width direction 12 in a form-fitting manner on the cooler block 8. In FIG. 5 a further embodiment for a coupling arrangement 11" is illustrated, at least the component thereof on the duct wall side.

Figure 2:
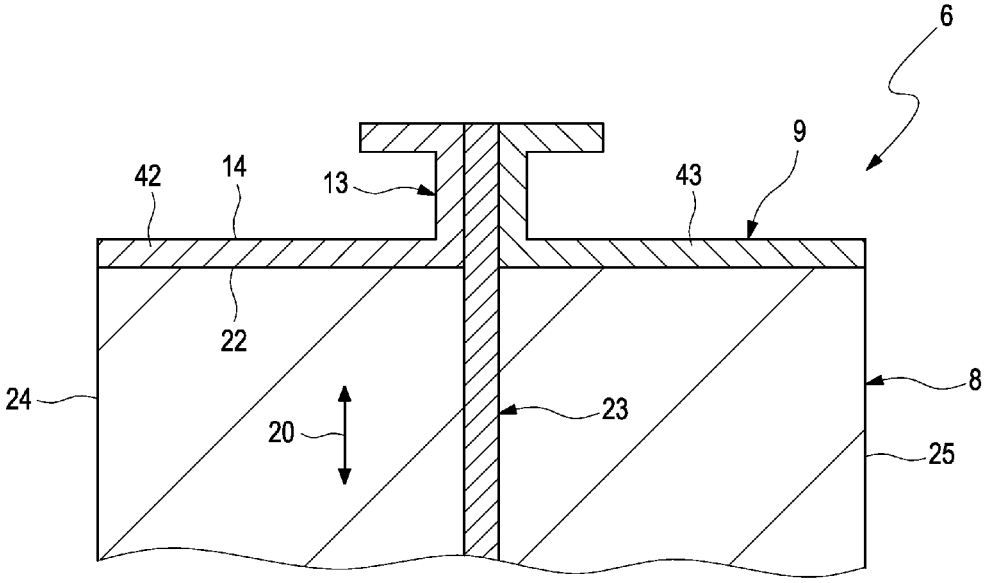

According to FIG. 2, at least one tension rod 23 can be arranged in the interior of the cooler block 8, such that it is spaced apart both from the inflow side 24 and also from the outflow side 25. Such an internal tension rod 23 then connects the two side parts 9 with one another in the interior of the cooler block 8. In the example of FIG. 2, the tension rod 23 penetrates the cooler block 8 completely and projects over the latter in the stacking direction 20. In this way, the tension rod 23 can be connected with the side parts 9 outside the cooler block 8. In this case, the tension rod 23 is integrated into the sealing contour 13 formed on the respective side part 9, which sealing contour is arranged on the outer side 14 of the respective side part 9. In order to be able to integrate the respective tension rod 23 particularly simply into the sealing contour 13, the respective side part 9 can be configured in two pieces in accordance with FIGS. 1 and 2, so that the respective side part 9 is composed of two individual parts 42, 43. The two side parts 42, 43 are shaped here so that they define on the edge side respectively a part of the sealing contour 13. On mounting onto the cooler block 8, the individual parts 42, 43 are arranged so that they abut one another for the formation of the sealing contour 13. This can be seen in the section plane of FIG. 1. For the integration of the respective tension rod 23, the tension rod 23 according to FIG. 2 extends into said joint, whereby the integration of the internal tension rod 23 is able to be realized particularly simply. The tension rod 23 can be soldered to the individual parts 42, 43, just as the individual parts 42, 43 abutting one another are soldered to one another. In the example which is shown, each individual part 42, 43 has on the edge side an L-shaped projection, which join together in the joint to the T-shaped profile of the sealing contour 13.

The respective tension rod 23, irrespective of the respective embodiment, extends in the width direction 12 of the cooler block 8 only over a relative small portion of the entire width of the cooler block 8. For example, the respective tension rod 23 extends in the width direction 12 over a maximum of 10%, preferably over a maximum of 5%, of the entire width of the cooler block 8.

The invention claimed is:

1. A heat exchanger for transferring heat between a gaseous first fluid and a liquid second fluid, comprising:

a plurality of hollow pipes which extend transversely through a first fluid path for conducting the first fluid, the plurality of pipes externally being thermally coupled to a plurality of cooling fins arranged in the first fluid path, the plurality of pipes and the plurality of cooling fins configured to be flowed through by the first fluid, and wherein the plurality of pipes internally define a second fluid path for conducting the second fluid, wherein the plurality of pipes and the plurality of cooling fins are stacked on one another in a stacking direction to define a cooler block, the stacking direction extending transversely with respect to a main flow direction of the first fluid in the first fluid path, wherein the cooler block includes two side parts extending along two outer sides of the cooler block facing away from one another in the stacking direction, wherein the two side parts laterally delimit the first fluid path, wherein the two side parts are fixedly connected to one another via at least one tension rod, which is a component separate from the plurality of cooling fins and the plurality of pipes, wherein the at least one tension rod is configured to transmit a tensile force in the stacking direction, the at least one tension rod defining an extent in a width direction of the cooler block extending over a portion of a width of the cooler block, wherein the width direction runs transversely to the stacking direction and transversely to the main flow direction of the first fluid, wherein the at least one tension rod is arranged externally on at least one of an inflow side and an outflow side of the cooler block with respect to the first fluid path, and the at least one tension rod includes a base extending along the stacking direction and a plurality of prongs projecting from the base along the main flow direction of the first fluid, the plurality of prongs including at least two exterior prongs remote from one another and at least one interior prong, wherein the at least two exterior prongs overlap the two side parts and the at least one interior prong engages into the cooler block.

2. The heat exchanger according to claim 1, wherein the at least one tension rod is configured as a U-shaped bracket and the at least two exterior prongs are each configured as a U-shaped leg, and wherein the respective U-shaped legs overlap an exterior side of the two side parts.

3. The heat exchanger according to claim 1, wherein the at least one tension rod is configured as a U-shaped bracket and the at least two exterior prongs are each configured as a U-shaped leg, and wherein the U-shaped legs contact the two side parts on an inner sides facing one another.

4. The heat exchanger according to claim 1, wherein the at least one tension rod is configured as a clip on at least one end remote from another end in the stacking direction, wherein the clip engages the respective side part on an edge side at least one of externally and internally with respect to the cooler block.

5. The heat exchanger according to claim 1, wherein at least one of the side parts in a region of the at least one tension rod projects over an end of the cooler block parallel to the main flow direction of the first fluid.

6. The heat exchanger according to claim 1, wherein the cooler block includes a depression in a region of the at least one tension rod, wherein the at least one tension rod at least partially projects into the depression.

7. The heat exchanger according to claim 1, wherein the at least one tension rod is a flat sheet metal part defining a plane in which the base and the plurality of prongs extend respectively with their flat cross-sections.

8. The heat exchanger according to claim 1, further comprising a second tension rod arranged in an interior of the cooler block between an inflow side and an outflow side of the cooler block with respect to the first fluid path, and wherein the second tension rod connects the two side parts to each other.

9. The heat exchanger according to claim 8, wherein the second tension rod projects over at least one of the side parts of the cooler block in the stacking direction and is connected externally to the cooler block with the at least one side part.

10. The heat exchanger according to claim 1, wherein at least one side part includes a sealing contour on an outer side facing away from the cooler block, and wherein the sealing contour extends at least one of transversely to the main flow direction of the first fluid and transversely to the stacking direction.

11. The heat exchanger according to claim 9, wherein the at least one tension rod is integrated into the sealing contour.

12. The heat exchanger according to claim 10, wherein the at least one side part includes two individual parts, and wherein the two individual parts of the at least one side part abut one another and are profiled to define the sealing contour.

13. The heat exchanger according to claim 1, wherein the extent of the at least one tension rod is a maximum of 10% of the entire width of the cooler block.

14. A fresh air system of an internal combustion engine comprising:

a fresh air duct for communicating a fresh air flow, a heat exchanger arranged in the fresh air duct and configured to receive the fresh air flow along a first fluid path of the heat exchanger, wherein the heat exchanger includes:

a plurality of hollow pipes extending transversely through the first fluid path for conducting the fresh air flow, the plurality of pipes externally being thermally coupled to a plurality of cooling fins arranged in the first fluid path and flowable through by the fresh air flow, wherein the plurality of pipes internally define a second fluid path for conducting a second fluid flow;

a cooler block defined at least by the plurality of pipes and the plurality of cooling fins arranged in the first fluid path stacked on one another in a stacking direction, the stacking direction extending transversely with respect to a main flow direction of the fresh air flow in the first fluid duct, wherein the cooler block includes two side parts extending along two outer sides of the cooler block facing away from one another in the stacking direction, the two side parts laterally delimiting the first fluid path;

at least one tension rod connecting the two side parts to one another and configured to transmit a tensile force in the stacking direction, the at least one tension rod configured as a separate component with respect to the plurality of pipes and the plurality of cooling fins;

wherein the at least one tension rod includes a base extending parallel to the stacking direction and a plurality of prongs projecting from the base parallel to the main flow direction, the plurality of prongs including at least two exterior prongs separated by at least one interior prong, and wherein the at least two exterior prongs overlap the two side parts and the at least one interior prong engages into the cooler block, wherein the at least one tension rod defines an extent in a width direction of the cooler block extending less than a width of the cooler block, the width direction extending transversely to the stacking direction and transversely to the main flow direction, and wherein the at least one tension rod is arranged on at least one of the inflow side and an outflow side of the cooler block with respect to the first fluid path; and wherein the fresh air duct is coupled with the two side parts of the heat exchanger.

15. The fresh air system according to claim 14, wherein the at least one tension rod defines a U-shaped bracket including at least two U-shaped legs, and wherein the U-shaped legs engage the two side parts on at least one of an inner side facing one another and an exterior side facing away from one another.

16. The fresh air system according to claim 14, wherein the at least one tension rod includes a clip on at least one end remote from another end in the stacking direction, wherein the clip engages at least one side part on an edge side at least one of externally and internally with respect to the cooler block.

17. The fresh air system according to claim 14, wherein at least one side part includes a sealing contour on an outer side facing away from the cooler block, the sealing contour extending transversely to the main flow direction and transversely to the stacking direction, and wherein the at least one tension rod is disposed in the sealing contour.

18. The fresh air system according to claim 17, wherein at least one side part includes two individual parts abutting one another, the two individual parts being profiled to define the sealing contour.

19. The fresh air system according to claim 14, wherein the extent of the at least one tension rod is 10% or less of the width of the cooler block.

* * * * *